United States Patent [19]

Mowry

[11] Patent Number: 4,962,684

[45] Date of Patent: Oct. 16, 1990

[54] CUTTING DEVICE FOR A BOARD MACHINE

[76] Inventor: Donald E. Mowry, P.O. Box 314, Norwalk, Ohio 44857

[21] Appl. No.: 334,338

[22] Filed: Apr. 7, 1989

[51] Int. Cl.[5] ..... B26D 1/24

[52] U.S. Cl. ..... 83/332; 83/345; 83/346; 83/503; 83/508.2; 83/677; 83/699; 493/370; 493/471

[58] Field of Search ..... 83/482, 492, 493, 495, 83/506, 505, 507, 508.2, 500, 503, 345–346, 430, 699, 688, 675, 677, 678, 332; 493/365, 366, 367, 368, 369, 370, 471, 475

[56] References Cited

U.S. PATENT DOCUMENTS

| | | | |
|---|---|---|---|
| 301,905 | 7/1884 | Lytle | 83/665 |
| 884,556 | 4/1908 | Bauer | 83/502 |
| 2,181,197 | 11/1939 | Moritz | 83/677 X |
| 2,888,076 | 5/1959 | Lanstrom . | |
| 3,302,506 | 2/1967 | Turner et al. | 83/665 |
| 3,786,706 | 1/1974 | Hyatt et al. | 83/493 X |
| 4,215,609 | 8/1980 | Coburn et al. | 83/492 |
| 4,572,047 | 2/1986 | Punater et al. | 83/481 |
| 4,781,668 | 11/1988 | Mowry | 83/498 X |
| 4,805,502 | 2/1989 | Ishigure | 493/475 X |

*Primary Examiner*—Frank T. Yost
*Assistant Examiner*—Rinaldi Rada
*Attorney, Agent, or Firm*—Emch, Schaffer, Schaub & Porcello Co.

[57] ABSTRACT

A cutting device for a board machine is disclosed. The board machine includes at least two parallel shafts. One shaft is mounted by eccentric assemblies which vary the center line of rotation of the shaft. A first cutter head is mounted on that shaft and a mating cutter head is mounted on the other shaft. The first cutter head includes a first cylindrical member having external teeth which mate with a second cylindrical member having internal teeth. The mating cutter head mounts a slotting knife and a cross knife, while the first cutter head mounts an adjustable knife. The eccentric assemblies eccentrically move the shaft to reorientate the first and second cylindrical members to move the adjustable knife relative to the slotting knife to cut or score boards of different thickness while maintaining a desired spacing between the cross knife and an anvil surface defined by the second member.

9 Claims, 7 Drawing Sheets

CUTTING DEVICE FOR A BOARD MACHINE

BACKGROUND OF THE INVENTION

This invention relates to a cutting device that is utilized for cutting or scoring corrugated board or rigid board such as that utilized for corrugated board or rigid board containers. More particularly, the present invention is directed to a cutting device which while adjusting the depth of cut of the main scoring knives maintains the cross knife in a desired spacing with an anvil surface.

A prior art cutting machine is shown in my U.S. Pat. No. 4,781,668, which was granted Nov. 1, 1988.

In prior art cutting machines, for example the one shown in the above-identified patent, cuts or scores are made in the board as it passes through the machine. If the thickness of the board is changed, the mating knives on the parallel shafts must be adjusted to accommodate this change in thickness. However, it is often necessary to make a cross cut for a tab in the box material. This cross cut is often made in a direction parallel to the axis of the machine shafts.

While the adjustment of the knives for the longitudinal cuts has been done relatively easily in the past, the adjusting of a cross cut blade and its anvil surface has been a time consuming process. Often the machine must be stopped and the cross cut knife manually adjusted several times to obtain the proper depth of cut on the cross cut or tab cut. It is apparent that when boards of different thickness are run through the same machine during the same day, the adjustment of the cross cut or tab blade relative to its anvil surface is a time consuming and, accordingly, expensive proposition.

It is the object of the present invention to provide a cutting device having automatic means for maintaining the desired cross cut knife and anvil relationship when the overall cutting machine is adjusted for boards of different thicknesses.

Further objects and advantages of the invention will be readily understood from the following description and drawings.

SUMMARY OF THE INVENTION

The invention is a cutting device for a corrugated board or solid fiber board machine. The machine normally has a plurality of parallel rotatable shafts. An eccentric assembly is positioned adjacent the ends on one of the shafts of a parallel pair. The eccentric assemblies move the center of rotation of the shaft. A first cutter head is mounted on the shaft having the eccentric assemblies. A mating cutter head having a slotting knife and a cross knife is mounted on the other shaft.

The first cutter head has first and second cooperating members, which in one embodiment include internal and external mating gear teeth. The first cooperating member mounts a mating adjustable cutter for cooperation with the slotting knife of the other shaft. The second cooperating member defines an anvil surface for cooperating with the cross knife mounted on the other shaft.

Limited rotation of the eccentric assemblies rotate the shaft eccentrically to reorientate the first and second cooperating members for adjustably moving said mating adjustable cutter to cut or score boards of different thicknesses while maintaining a desired cutting spacing between the cross knife and the anvil.

DESCRIPTION OF THE PREFERRED EMBODIMENT

Figure 1:
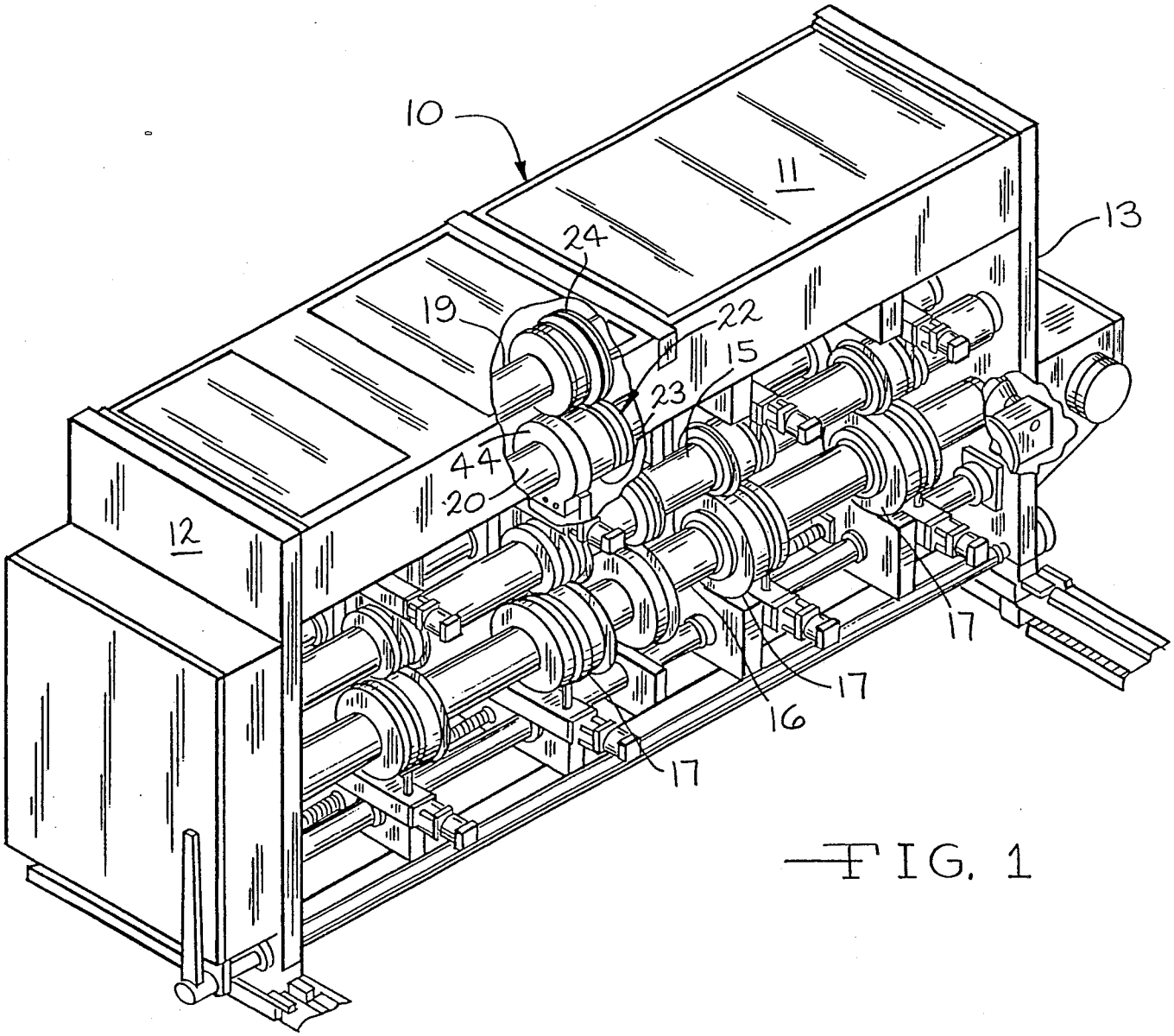
FIG. 1 is a perspective view of a machine used for cutting or scoring corrugated board or solid fiber board, with a part broken away showing a portion of a cutting device, according to the present invention.

A board machine for cutting or scoring corrugated or rigid fiber board is generally indicated in FIG. 1 by the reference number 10. The machine 10 includes a housing 11 and opposed end plates 12 and 13. Pairs of parallel shafts are carried by the end plates 12 and 13. A first set of parallel shafts 15 and 16 are shown in FIG. 1. The shafts 15 and 16 mount a plurality of heads 17.

Also referring to FIG. 1, a second pair of parallel shafts 19 and 20 are indicated. A cutting device according to the present invention is generally indicated by the reference number 22. The cutting device 22 includes a first cutter head 23 mounted on the shaft 20 and a mating cutter head 24 mounted on the shaft 19.

Figure 8:
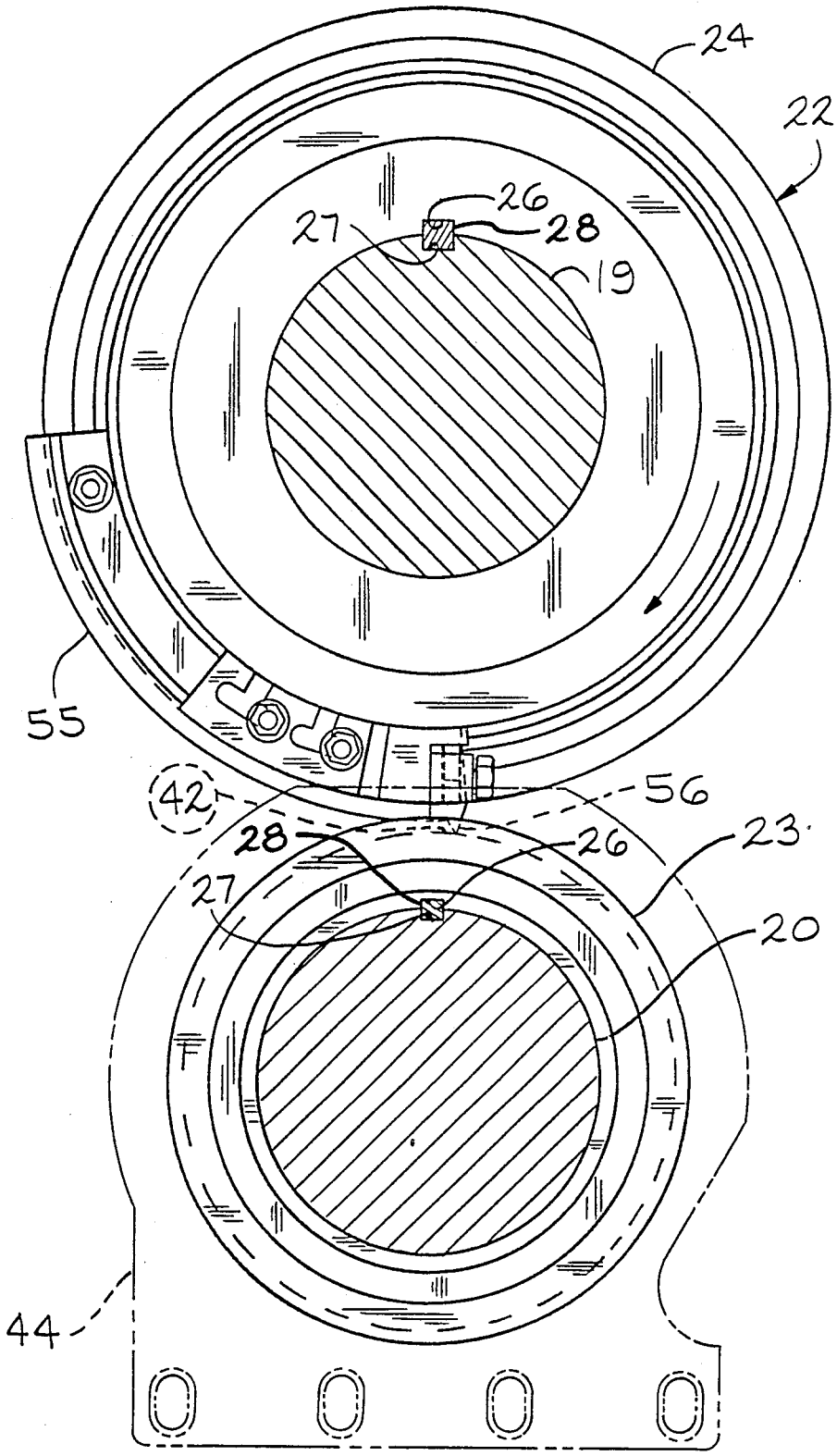
FIG. 8 is a cross-sectional view taken along the line 8—8 of FIG. 6.

A plurality of the first cutter heads 23 and mating cutter heads 24 are mounted on the shafts 19 and 20 at various locations along the shafts. The first cutting heads 23 and mating cutting heads 24 define keyways 26 as shown in FIG. 8 which are aligned with keyways 27 defined in the shafts 19 and 20. Keys 28, as shown in FIGS. 2 and 8, are inserted in the keyways 26 and 27 to slideably secure the cutter heads 24 and 23 to the respective shafts 19 and 20.

Figure 2:
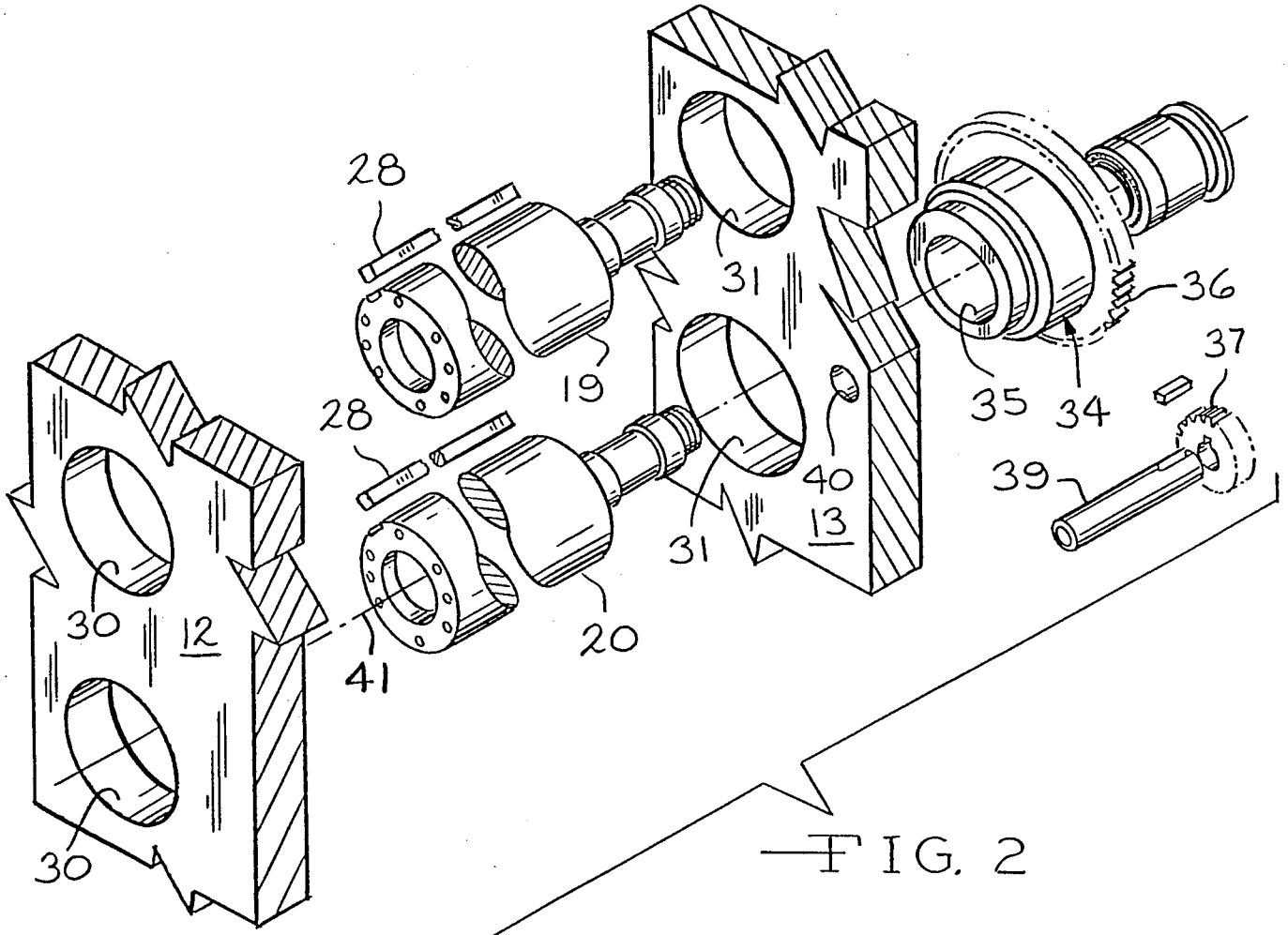
FIG. 2 is a fragmentary, exploded view showing the end walls of the machine, shown in FIG. 1, and showing fragments of the parallel rotatable shafts together with one of the eccentric assemblies mounted on the lower shaft.

Referring to the exploded view, FIG. 2, the cutting heads 23 and 24 are not shown. FIG. 2 illustrates how the shafts 19 and 20 are received by openings 30 and 31 defined in the end plates 12 and 13 of the machine 10. The shafts 19 and 20 are rotatable by drive mechanisms. An eccentric assembly 34 is a portion of the overall cutting device invention and has an opening 35 which receives one end of the lower shaft 20. An eccentric assembly 34 is located at each end of the lower shaft 20. The eccentric assembly 34 includes a ring gear 36 which meshes with a drive gear 37. A stub shaft 39 is keyed to the drive gear 37 and is received in an opening 40 in the end plate 13. When the stub shaft 39 is rotated, either manually, mechanically, or electronically, and the ring gear 36 of the eccentric assembly 34 is rotated through a small angular sector, the longitudinal center line 41 of the lower shaft 20 is eccentrically moved. It should be understood that the eccentric movement is normally never more than 90 degrees and is often much less. Also, the main shaft drive of the shaft 20 is independent of the drive for the drive gears 37.

Figure 3:
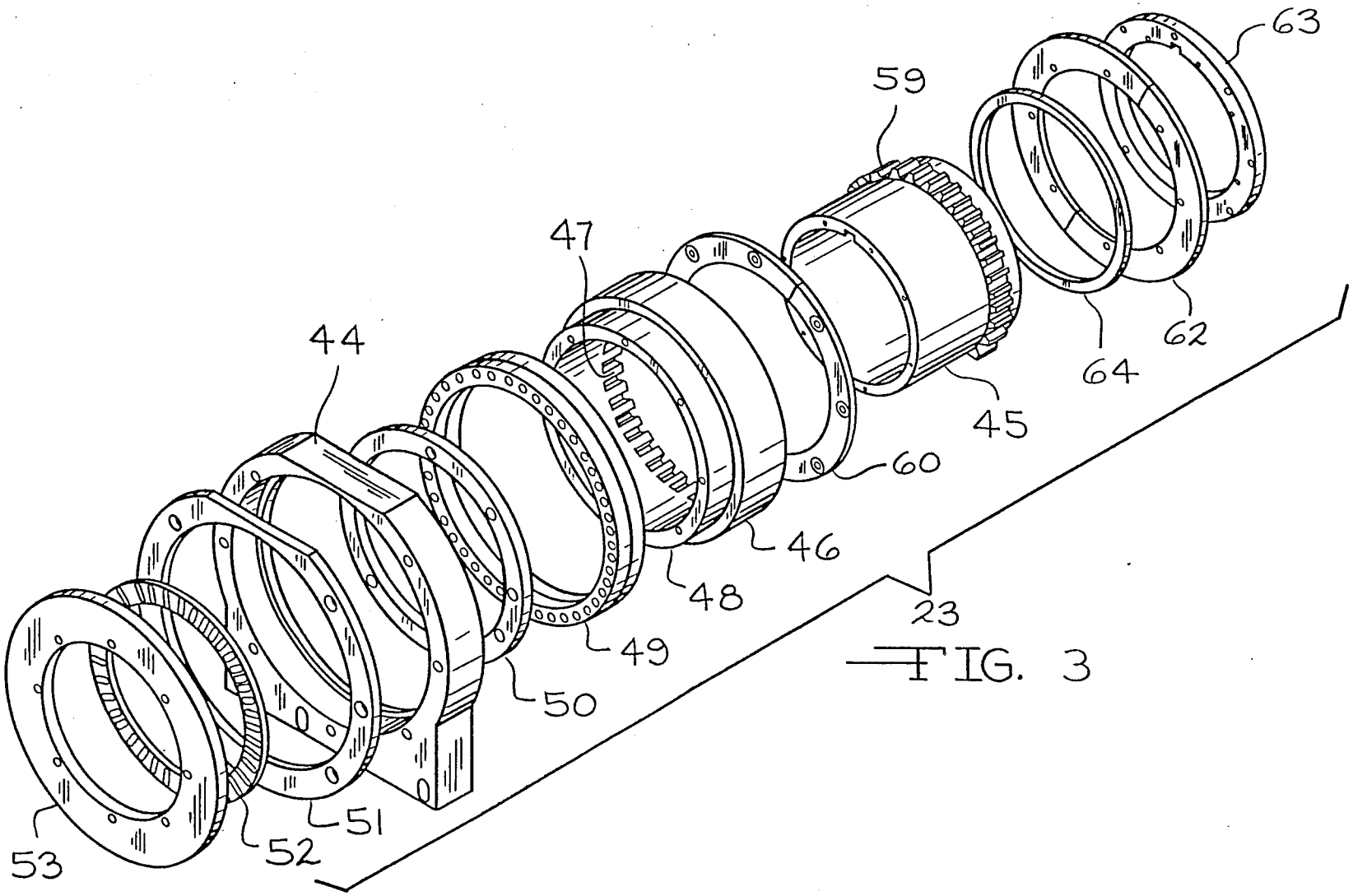
FIG. 3 is an exploded perspective view showing a portion of the cutting device, according to the present invention.
Figure 5:
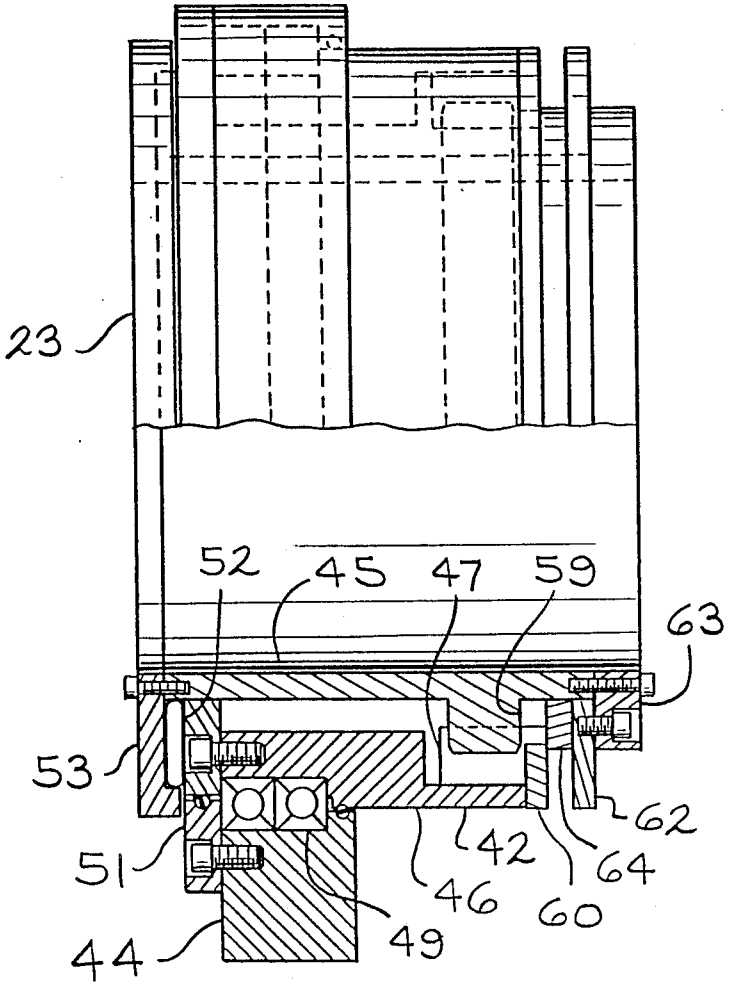
FIG. 5 is a side view, partially in cross section, of the apparatus shown in FIG. 4.
Figure 4:
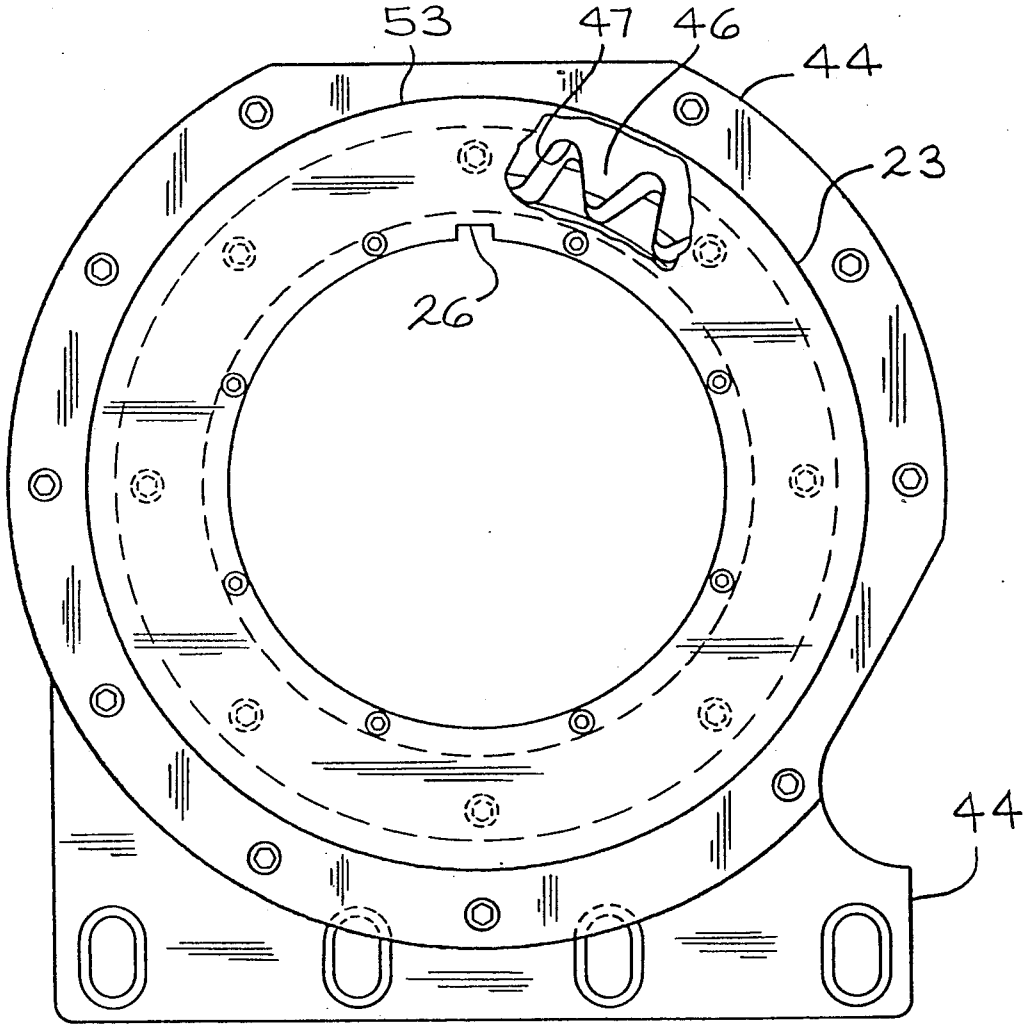
FIG. 4 is an end view of the apparatus shown in FIG. 3 in an assembled position, with a break away portion showing the first and second cooperating members.

Referring to FIGS. 3, 4 and 5, the first cutter head 23 includes a bearing housing 44 which is stationarily mounted on a frame member of the machine 10. The bearing housing 44 mounts first and second cooperating members 45 and 46. The second cooperating member 46 is generally cylindrical and has a plurality of internal teeth 47 defined therein together with a center hub 48. The hub 48 mounts a bearing assembly 49 and a bearing retainer 50 and is positioned in the bearing housing 44. As best shown in FIG. 5, a retainer 51 is mounted on the exterior of the bearing housing 44. A thrust bearing 52 is received by the lower shaft 20 and an end cap 53 also surrounds the shaft 20.

In the present embodiment, the mating cutter head 24 mounts a slotting knife 55. As shown in FIG. 8, the slotting knife 55 is arcuate and extends around a portion of the periphery of the mating cutter head 24. A cross knife 56 having a cutting surface perpendicularly disposed to the slotting knife 55 is mounted adjacent one end of the slotting knife 55. The location of the cross knife depends on the geometry of the tab being scored or cut by the cross knife.

In this particular embodiment, the first cutter head 23 includes a stationary knife 60 which is circular and is mounted at one end of the second cooperating member 46, as best shown in FIG. 5.

The first cooperating member 45, in the present embodiment, is cylindrically shaped and includes a plurality of external gear teeth 59 on its periphery. The first cooperating member 45 is positioned within the second cooperating member 46 and the external gear teeth 59 are received by the internal teeth 47. In the present embodiment, there are equal numbers of internal teeth 47 and external teeth 59. The internal teeth 47 and the external teeth 59 have different pitch diameters but have equal or similar pitch profiles. The smaller pitch diameter ensure that there will be contact at the side edges between the mating teeth at different locations around the periphery to ensure mechanical support for the mating knife (see FIGS. 4, 9 and 10). It is understood that the relative rotation or movement between the internal teeth 47 and external teeth 59 are limited. The relationship between the knives 60–62 and 55 changes only when the ring gear 36 of the eccentric assembly 34 is moved. However, the design of the internal teeth 47 and external teeth 59 with the different pitch diameter but with equal pitch profiles is important in that at all times ensures the above-mentioned mechanical support for the overall cutting device 22.

The first cooperating member 45 mounts a mating adjustable knife or cutter 62. The mating adjustable knife 62 is retained by a circular knife retainer 63. As shown in FIG. 5, a spacer 64 is positioned between the stationary knife 60 which is connected to the second cooperating member 46 and the mating adjustable knife 62 which is connected to the first cooperating member 45. The knives 60 and 62 form a female knife assembly for the reception of the male slotting knife 55 mounted on the mating cutter head 24.

Figure 9:
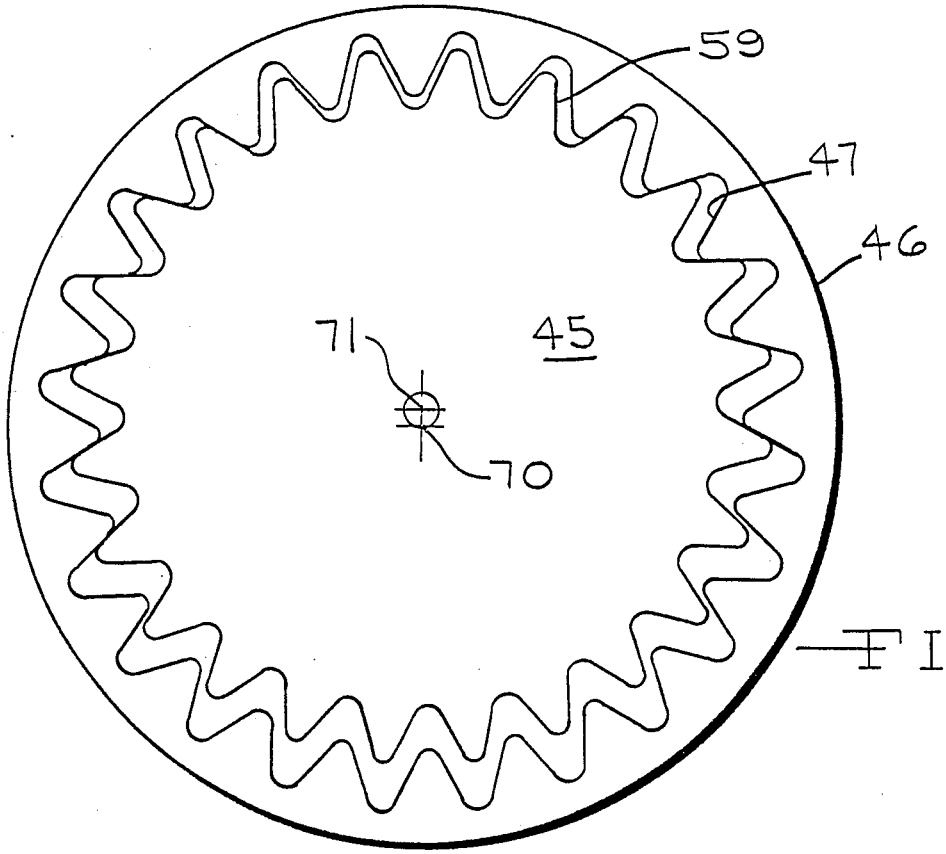
FIG. 9 is a diagrammatic plan view showing the first and second cooperating members of a cutting device, according to the present invention, in a first orientation.
Figure 10:
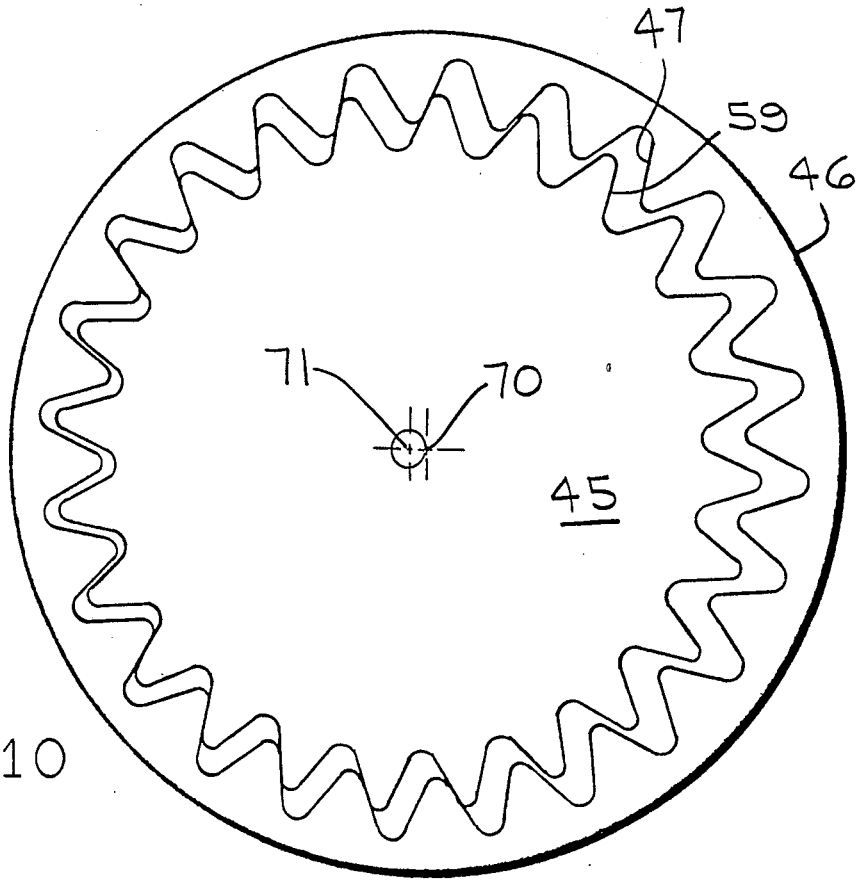
FIG. 10 is a diagrammatic view similar to FIG. 9 showing the first and second cooperating members after they have been orientated by movement of the eccentric assembly.

Referring to FIGS. 9 and 10, these illustrations show the relative movements of the first cooperating member 45 and its external teeth 59 and the second cooperating member 46 and its internal teeth 47. The reference number 70 indicates the longitudinal center line of the outer second cooperating member 46 while the reference number 71 indicates the longitudinal center line of the inner or first cooperating member 45. At all times, the center line 70 of the second cooperating member 46 remains at the same location. Referring to FIG. 5, that means that an anvil surface 42 remains constant at all times together with the stationary knife 60.

Upon movement of the eccentric assemblies 34, there is a repositioning of the relative locations of the first and second cooperating member 45 and 46. As shown in FIGS. 9 and 10 the center line 71 of the first cooperating member 45 is moved. This movement is translated to the mating adjustable knife or eccentric knife 62. The movement of this knife 62 is the movement which adjusts the cutting depth when the female knives 60 and 62 cooperate with the slotting knife 55 of the mating cutting head 24 which in the present embodiment is located on the upper shaft 19. It is understood that the cutting heads 23 and 24 may be reversed with respect to the shafts 19 and 20 without departing from the scope of the present invention.

Figure 6:
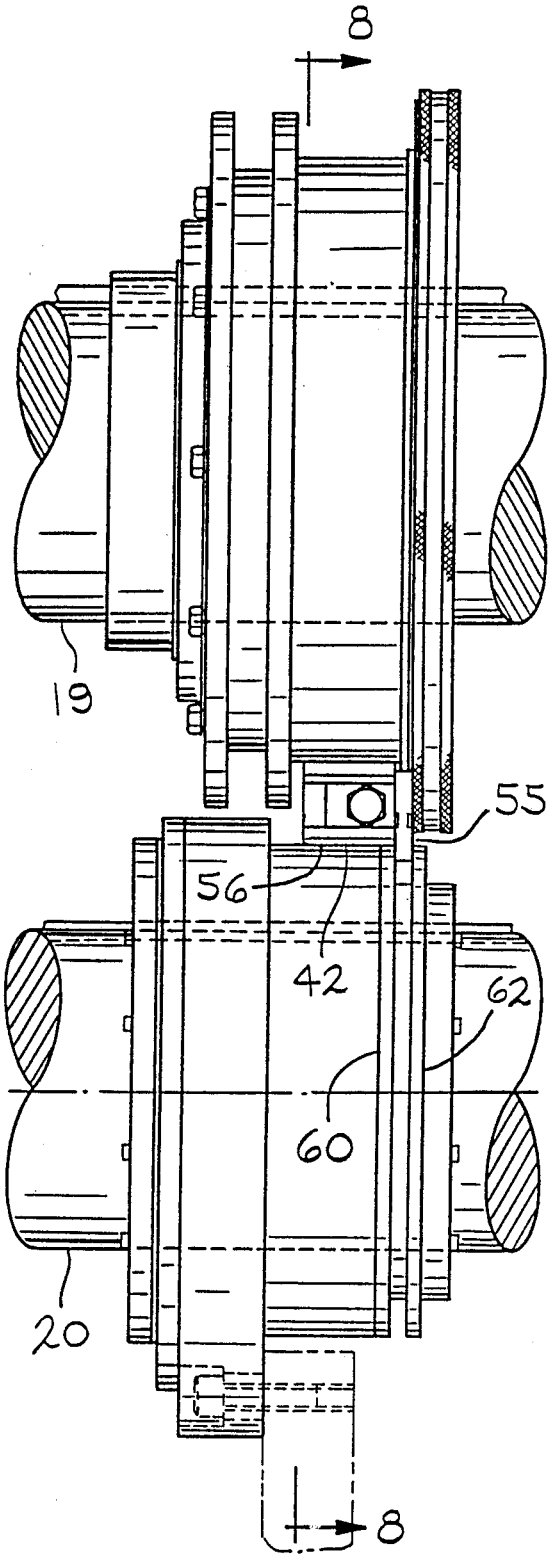
FIG. 6 is an elevational view showing the cutting head apparatus in FIG. 4 mounted on the lower shaft and a cooperating cutter head mounted on the upper shaft.
Figure 7:
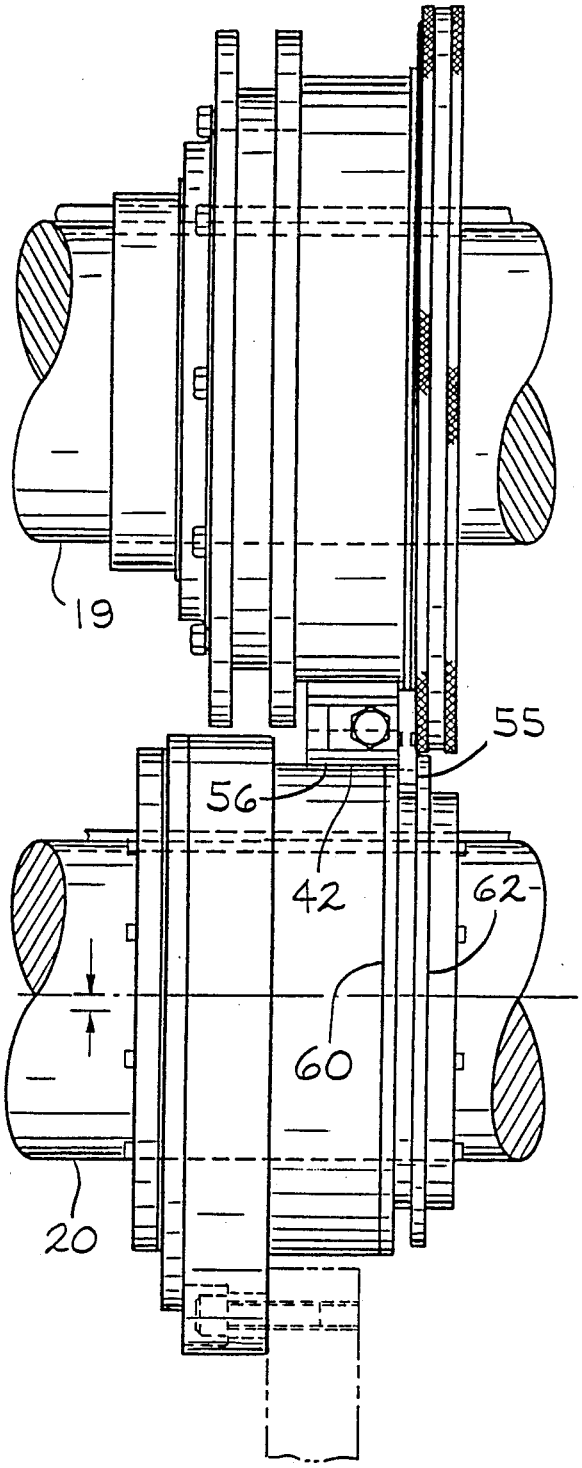
FIG. 7 is a view similar to FIG. 6 after the first and second cooperating members of the cutting device, according to the present invention, have been reorientated, whereby the mating adjustable cutter has been moved to cut or score boxes of different thickness while maintaining a desired cutting spacing between the cross knife and the anvil.

Referring to FIGS. 6 and 7, the cross head knife 56 is initially adjusted at the beginning of the operation to set the desired spacing between the cross head knife 56 and the anvil surface 42. Because these two items remain constant throughout the operation, even when the eccentric assemblies 34 are operated and the relative repositioning occurs by movement of the adjustable knife or eccentric knife 62, it is never necessary to again readjust the cross head knife 56 during the operation. The cross head knife 56 needs only to be replaced or adjusted during new setups. It does not have to be adjusted merely to adjust for the thickness of boards as the adjustable knife 62 is moved.

Referring to FIGS. 6 and 7, the rollers 19 and 20 are driven rollers. As shown, by electronically or otherwise energizing the eccentric assemblies 34, the depth of the cut may be adjusted between a wide gap, as shown in FIG. 6, where the eccentric knife 62 is in its widest position and a narrow gap, as shown in FIG. 7, where the gap of the eccentric knife 62 is in its narrowest position.

Referring to FIG. 9, which shows diagrammatically the positions of the first and second cooperating members 45 and 46 as the center line 71 is translated, it can be seen how the members move relative to one another and also how the provision of having the mating teeth provides support for the units by always having a series of side surfaces of the teeth engaging.

A cutting device, according to the present invention, provides an automatic means for maintaining the desired cross knife and anvil relationship while the eccentric knife is adjusted for boards of different thicknesses.

It is understood that many revisions and modifications may be made to the disclosed structure without departing from the following claims.

What I claim:

1. A cutting device for a corrugated board or solid fiber board machine, said machine having at least one pair of parallel first and second rotatable shafts, an eccentric means operatively connected to said first shaft for moving the center of rotation of said first shaft, at least one first cutter head mounted on said first shaft, a mating cutter head having a slotting knife mounted on said second shaft, said mating cutter head having a cross knife mounted thereon, said first cutter head having first and second cooperating members, said first member mounting a mating adjustable cutter for cooperation with said slotting knife, said second member defining an anvil surface for cooperation with said cross knife, whereby limited rotation of said eccentric means eccentrically reorientates said first and second cooperating members for adjustably moving said mating adjustable cutter to cut or score boards of different thickness while maintaining a desired cutting spacing between the cross knife and said anvil surface.

2. A cutting device, according to claim 1, wherein said first cooperating member includes a plurality of external teeth and said second cooperating member includes a plurality of internal teeth, said external teeth and said internal teeth mating with one another.

3. A cutting device, according to claim 2, wherein said first cooperating member is mounted on said first shaft and said second cooperating member surrounds said first cooperating member.

4. A cutting device, according to claim 3, wherein there are equal numbers of said internal teeth and of said external teeth and wherein said internal teeth and said external teeth have different pitch diameters and similar pitch profiles.

5. A cutting device for a corrugated board or solid fiber board machine, said machine having at least one pair of parallel first and second rotatable shafts, an eccentric means operatively connected to said first shaft for moving the center of rotation of said first shaft, at least one first cutter head mounted on said first shaft, a mating cutter head having a slotting knife mounted on said second shaft, said mating cutter head having a cross knife mounted thereon, said first cutter head having first and second cooperating members, said first member mounting a mating adjustable cutter for cooperation with said slotting knife, said second member defining an anvil surface for cooperation with said cross knife, said eccentric means comprising an eccentric assembly connected to said first shaft, said eccentric assembly defining an eccentric opening for receiving said first shaft, a first gear adjacent such opening and drive means engaged with said gear for rotating said eccentric opening wherein rotation of said eccentric opening reorientates said first shaft and said first and second cooperating members for adjustably moving said mating adjustable cutter to cut or score boards of different thickness while maintaining a desired cutting spacing between said cross knife and said anvil surface.

6. A cutting device, according to claim 5, wherein said drive means includes a drive gear engageable with said first gear.

7. A cutting device for a corrugated board or solid fiber board machine, said machine having at least one pair of parallel first and second rotatable shafts, an eccentric assembly operatively connected to said first shaft for moving the center of rotation of said first shaft, at least one first cutter head mounted on said first shaft, a mating cutter head having a slotting knife mounted on said second shaft, said mating cutter head having a cross knife mounted thereon, said first cutter head having first and second cooperating members, said first cooperating member comprising a cylindrical member keyed to said first shaft for rotational movement therewith and a plurality of external teeth defined on its exterior, said second cooperating member comprising a generally cylindrical member positioned over said first member and defining a plurality of internal teeth mating with said external teeth, said first member mounting a mating adjustable cutter for cooperation with said slotting knife, said second member defining an anvil surface for cooperation with said cross knife, whereby limited rotation of said eccentric assembly eccentrically moves said first shaft to reorientate said first and second cooperating members for adjustably moving said mating adjustable cutter to cut or score boards of different thickness while maintaining a desired cutting spacing between the cross knife and said anvil surface.

8. A cutting device, according to claim 7, wherein there are an equal number of interal teeth and external teeth.

9. A cutting device, according to claim 8, wherein said internal teeth and said external teeth have different pitch diameters and similar pitch profiles.

* * * * *